US007211058B1

(12) United States Patent
Chung et al.

(10) Patent No.: US 7,211,058 B1
(45) Date of Patent: May 1, 2007

(54) ELECTRIC-POWERED MECHANICAL SINGLE-PLANK BED

(76) Inventors: Yin-Su Chung, No. 54, Lane 5, Sinyi St., Nantou City, Nantou County 540 (TW); Tung-Cheng Hsu, No. 1, Yunei Lane, Ershuei Township, Changhua County 530 (TW)

( * ) Notice: Subject to any disclaimer, the term of this patent is extended or adjusted under 35 U.S.C. 154(b) by 0 days.

(21) Appl. No.: 11/404,842

(22) Filed: Apr. 17, 2006

(51) Int. Cl.
*A61H 19/00* (2006.01)

(52) U.S. Cl. ..... 601/98; 601/101

(58) Field of Classification Search ..... 601/7–102
See application file for complete search history.

(56) References Cited

U.S. PATENT DOCUMENTS 4,277,857 A * 7/1981 Svehaug ..... 5/610
4,787,104 A * 11/1988 Grantham ..... 5/613
4,999,861 A * 3/1991 Huang ..... 5/600

* cited by examiner

*Primary Examiner*—Michael A. Brown
(74) *Attorney, Agent, or Firm*—Rabin & Berdo, P.C.

(57) ABSTRACT

The present invention discloses an electric-powered mechanical single-plank bed or chair comprising a hanging frame disposed separately at four corners of a bed base, a suspending stand disposed under a single bed plank, such that a suspensor is installed between the hanging frame and the suspending stand for sustaining a heavy weight, and a plurality of motive power motors are installed in the bed base and a cam is installed at a spindle of the motive power motor and engaged at a position under the bed plank corresponding to the driving frame for limiting its position, so that when the motive power motor is turned on to drive the cam to operate, the bed plank is pushed back and forth by the cam to produce a back-and-forth or sideway sway, so as to achieve the swaying effect by a mechanical method.

2 Claims, 9 Drawing Sheets

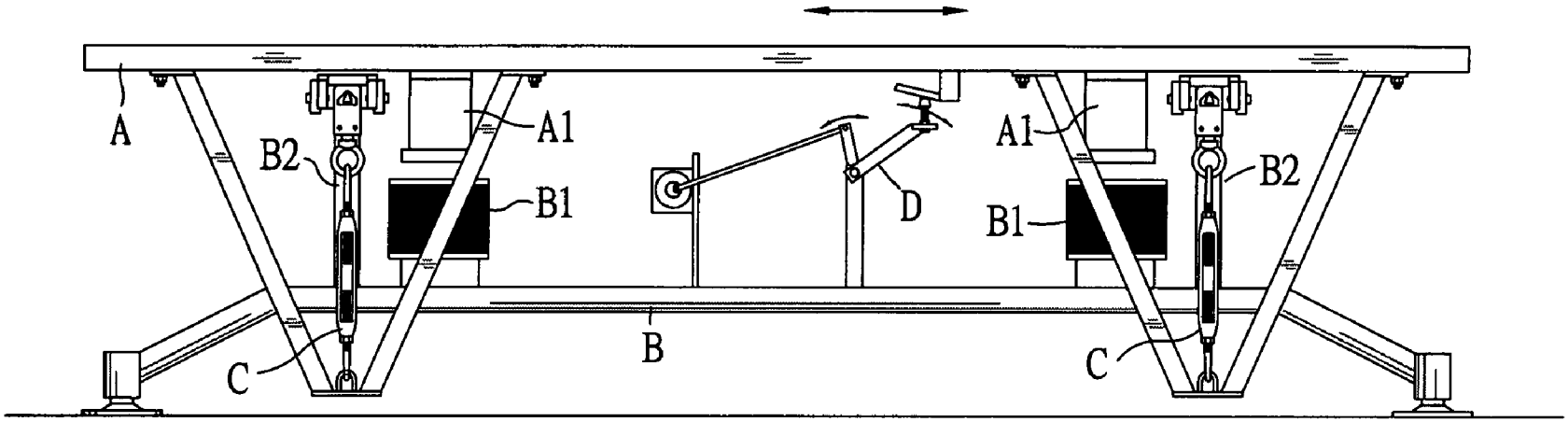
FIG. 2-A
PRIOR ART

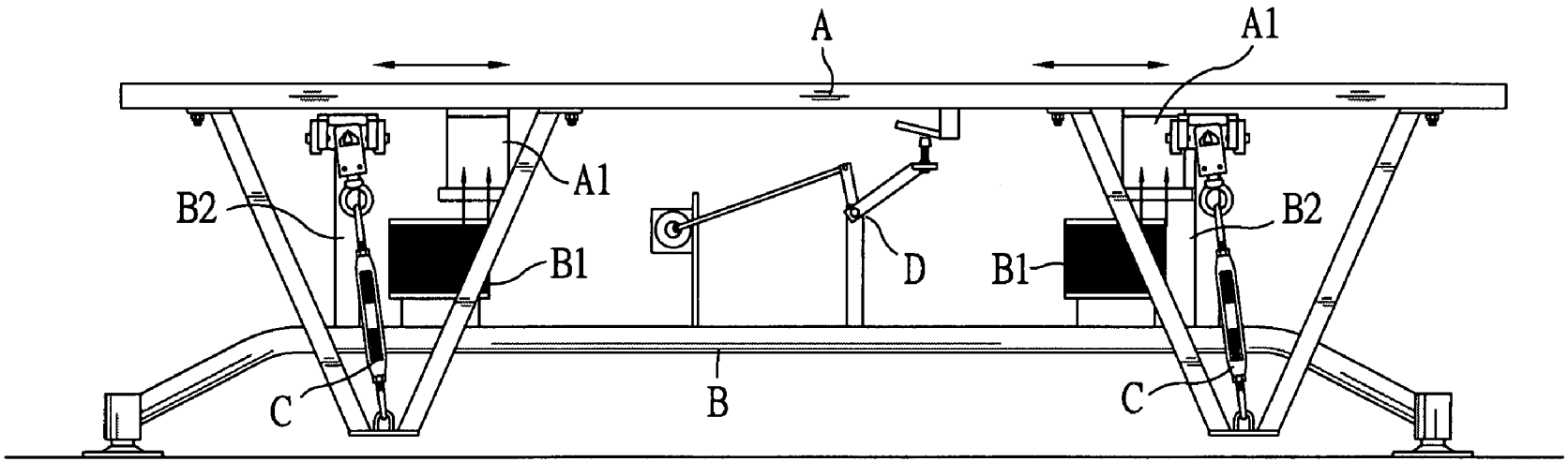
FIG.2-B
PRIOR ART

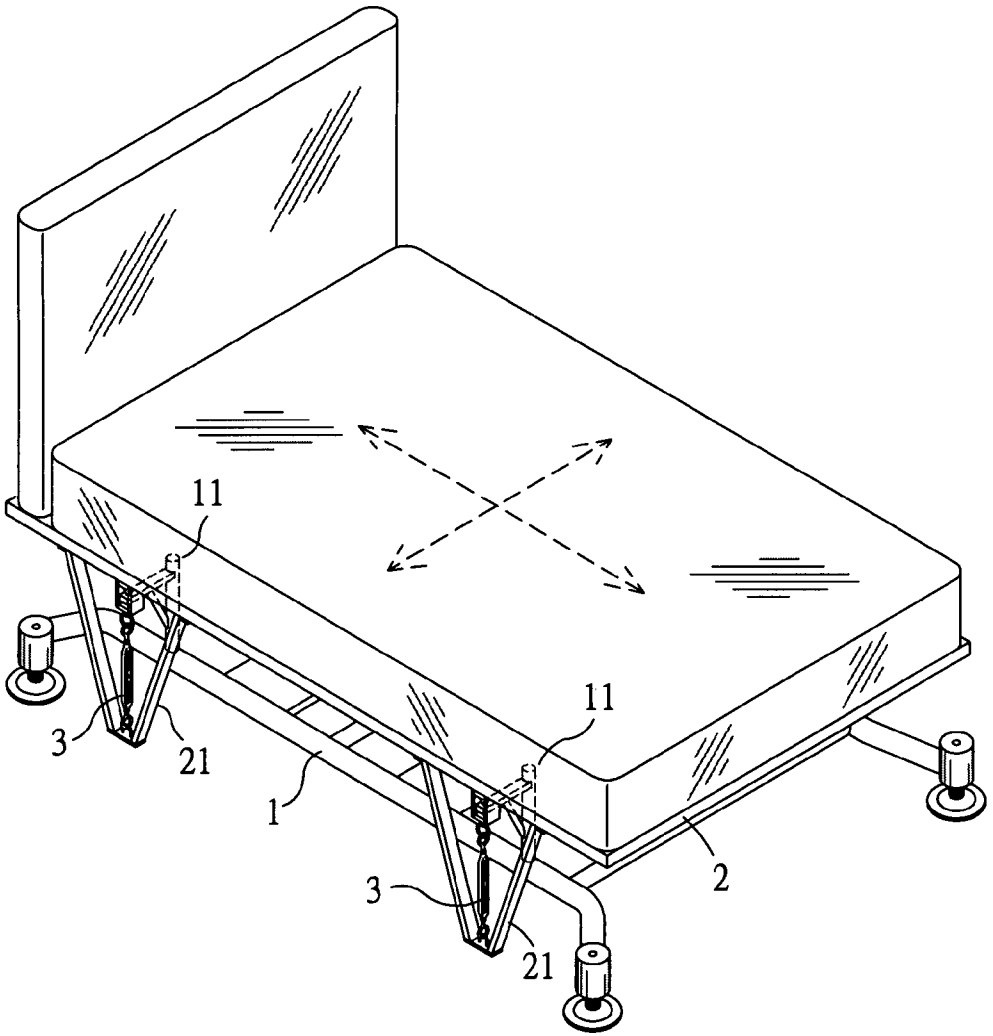
FIG. 3-A

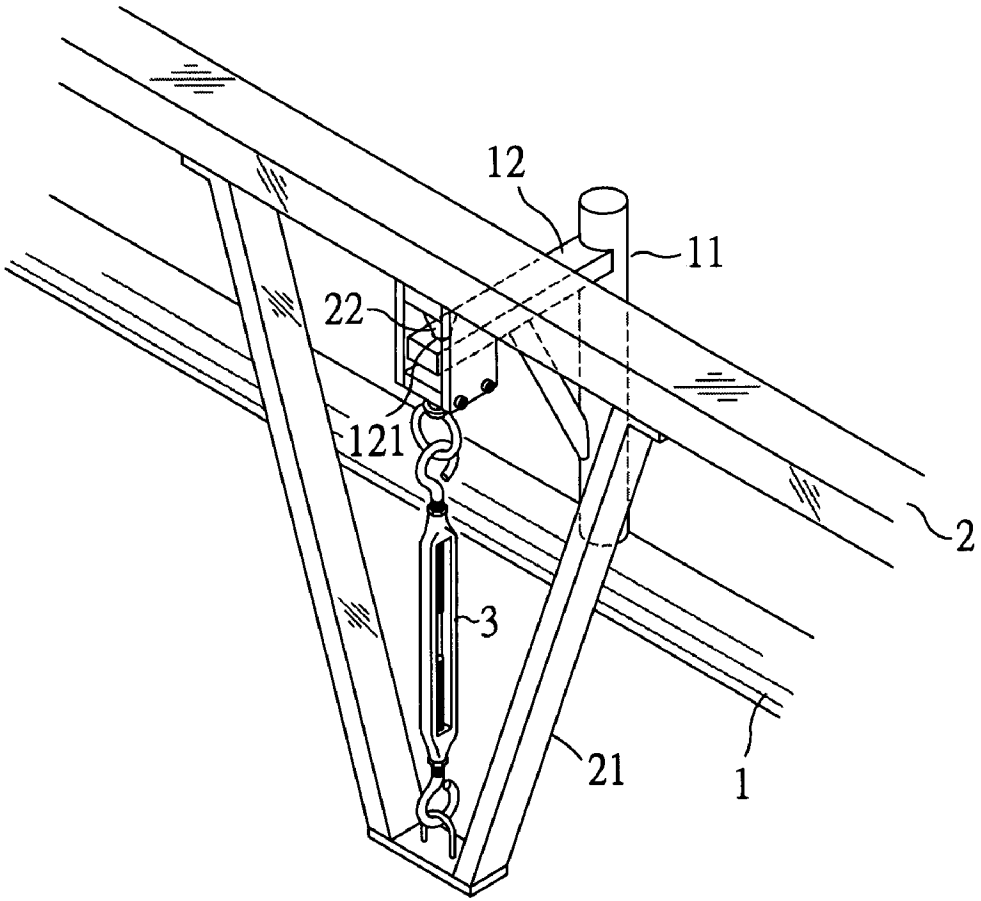
FIG. 3-B

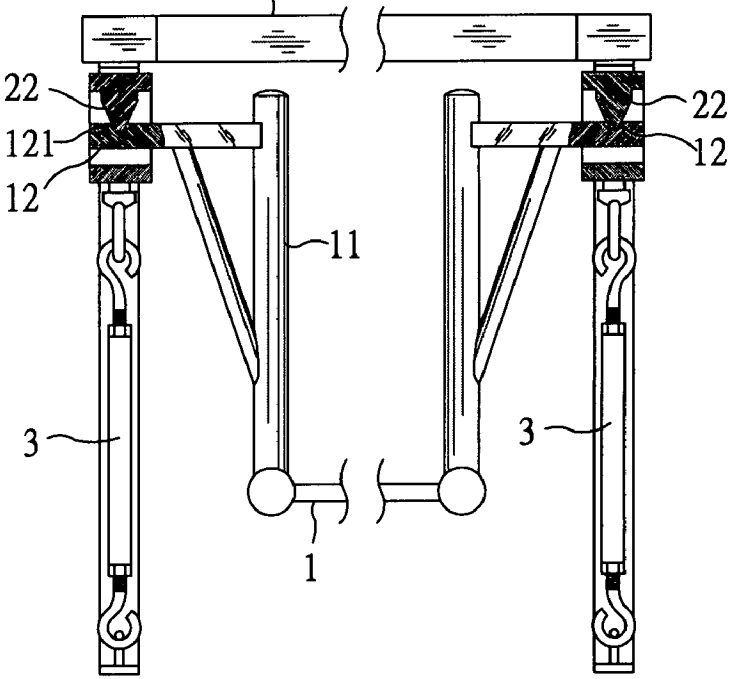
FIG. 4-B
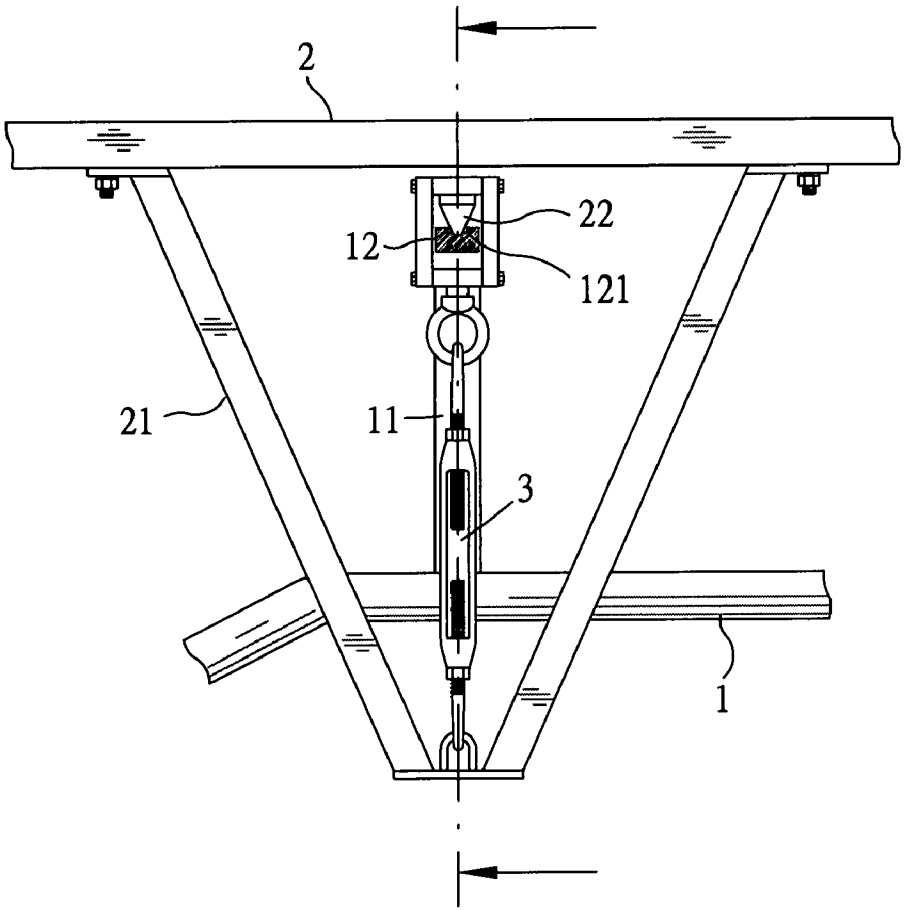
FIG. 4-A

ELECTRIC-POWERED MECHANICAL SINGLE-PLANK BED

BACKGROUND OF THE INVENTION

1. Field of the Invention

The present invention relates to an electric-powered mechanical single-plank bed or chair, and more particularly to an electric-powered mechanical single-plank bed or chair driven by a motor installed at a bed base to mechanically drive a cam to move downward, so as to produce a back-and-forth or sideway sway.

2. Description of the Related Art

Many designs of electric-powered beds provide a more comfortable effect when users lie down on the beds. With a high-tech ergonomic design, a large number of beds with advanced electronic designs are available in the market, and electric powered beds are no exception. There are floating beds designed according to the electromagnetic principle as shown in FIGS. 1, 2A and 2B. In other words, a magnetic plate μl is installed under a bed plank A and a plurality of electromagnetic windings B1 are installed at positions corresponding to the magnetic plate μl installed under the bed base B and the bed plank A, and the bed plank A is hanged to the hanging frame B2 of the bed base by the suspensor C. When the electromagnetic windings B1 start producing magnetic force, the magnetism produced by the magnetic force repels the magnetism of the magnetic plate μl under the bed plank A and thus produces a "floating" phenomenon. By then, an auxiliary pushing device D under the bed plank A pushes the bed plank A to move back and forth and thus the bed plank A keeps moving continuously. However, all these electromagnetic products have an arguable problem that their electromagnetic waves may or may not have adverse effects on human bodies. Since these products are driven by electromagnetic waves and the electromagnetic waves are proven to have adverse effect on human bodies, the quantity of energy directly causes brain waves and a change of organs. Although there are still arguments, nobody denies the such effects on human beings psychologically and physiologically, since the interference of these waves have already affected our body regarding the balance of electromagnetic field of the earth. Although we enjoy the convenience brought by these products, yet there exist intangible killers around us.

SUMMARY OF THE INVENTION

In view of the description above, the inventor of the present invention positively developed the present invention and filed a patent application for the invention. The objective of the present invention is to provide an electric-powered mechanical single plank bed or chair comprising a hanging frame disposed separately at a front left, a front right, a rear left and a rear right positions of a bed base, a suspending stand disposed under a single bed plank, such that a suspensor is installed between the hanging frame and the suspending stand for sustaining a heavy weight, and a plurality of motive power motors are installed in the bed base, and a cam is installed at a spindle of the motive power motor and engaged at a position under the bed plank corresponding to the driving frame for limiting its position, so that when a controller turns on the motive power motor to drive the cam to operate, the bed plank is pushed to move back and forth by the cam to produce a back-and-forth or sideway sway.

Another objective of the present invention is to provide an electric-powered mechanical single plank bed or chair, wherein the hanging frame and the suspending stand are provided for hanging the suspensor and the bed plank coupled with the bed plank includes a conical fixing member, and a rod stand of the hanging frame of the bed base includes a conical hole, such that a conical fixing member of the bed plank is installed into the conical hole of the rod stand on the hanging frame, and a turning angle of 360 degrees on a conical surface achieves a free movement without any restricted angle.

BRIEF DESCRIPTION OF THE DRAWINGS

FIG. 2A is a schematic view of preparing the movement of a traditional structure;

FIG. 2B is a schematic view of starting the movement of a traditional structure;

FIG. 3A is a perspective view of a structure of the invention;

FIG. 3B is an enlarged view of a portion of a structure of the invention;

FIG. 4A is another enlarged view of a portion of a structure of the invention;

FIG. 4B is a further enlarged view of a portion of a structure of the invention

DETAILED DESCRIPTION OF THE PREFERRED EMBODIMENTS

Figure 1:
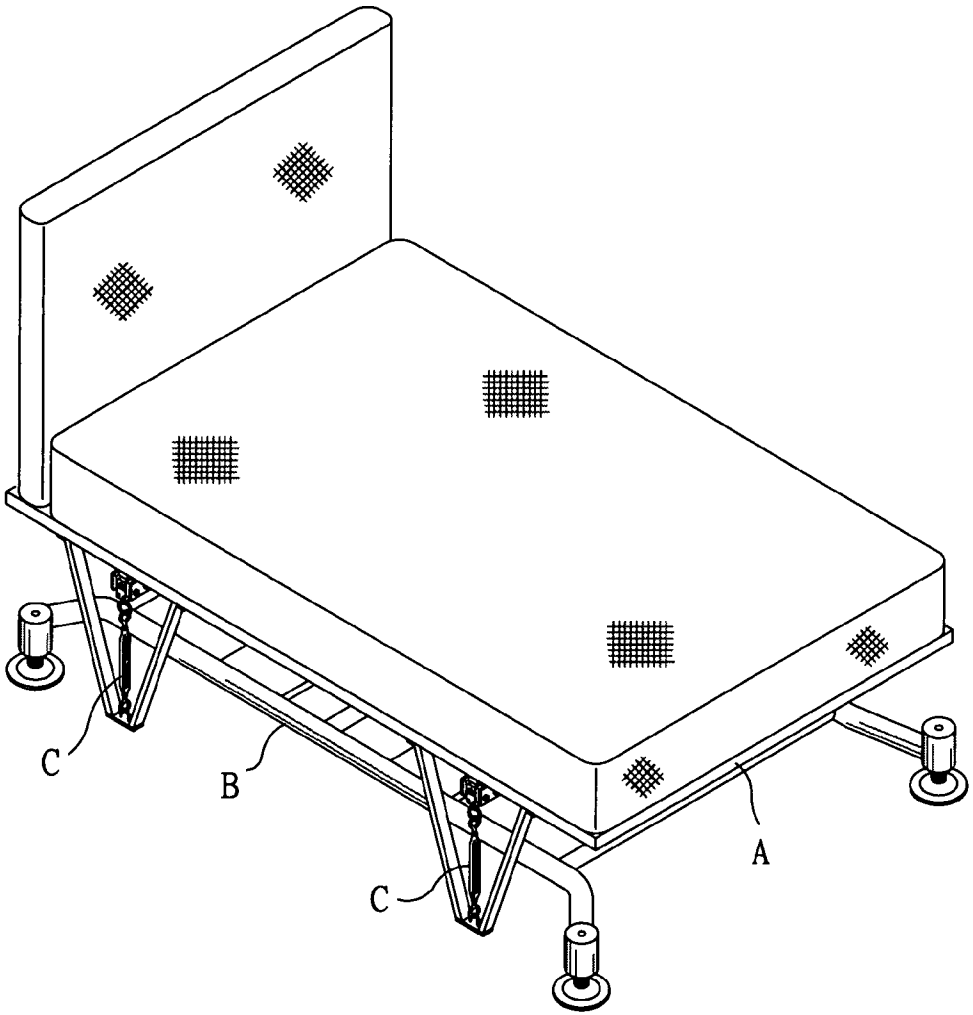
FIG. 1 PRIOR ART
FIG. 1 is a perspective view of a traditional structure.

Referring to FIGS. 3A, 3B, 4A and 4B, an electric-powered mechanical single-plank bed or chair comprises a vertical hanging frame 11 installed at the four corner positions of a single bed plank 2 at a bed base 1, a suspending stand 21 installed at the bottom of the bed plank 2, and a suspensor 3 hung between the hanging frame 11 and the suspending stand 21 for sustaining a heavy weight. The bed plank 2 includes a conical fixing member 22. A rod stand 12 of the hanging frame 11 of the bed base 1 includes a conical hole 121, such that each conical fixing member 22 in the bed plank 2 is installed into the conical hole 121 of a rod stand 12 on the hanging frame 11 of the bed base 1 (as shown in FIGS. 4A and 4B). With the design of a turning angle of 360 degrees on the conical surface, a free movement without any restricted angle can be achieved. The bed base 1 includes a plurality of motive power motors 13, so that the spindle of each motive power motor 13 moves a cam 14 engaged at a position under the bed plank 2 at a position corresponding to the driving frame 23 for limiting its position (as shown in FIGS. 5 and 6).

Figure 5:
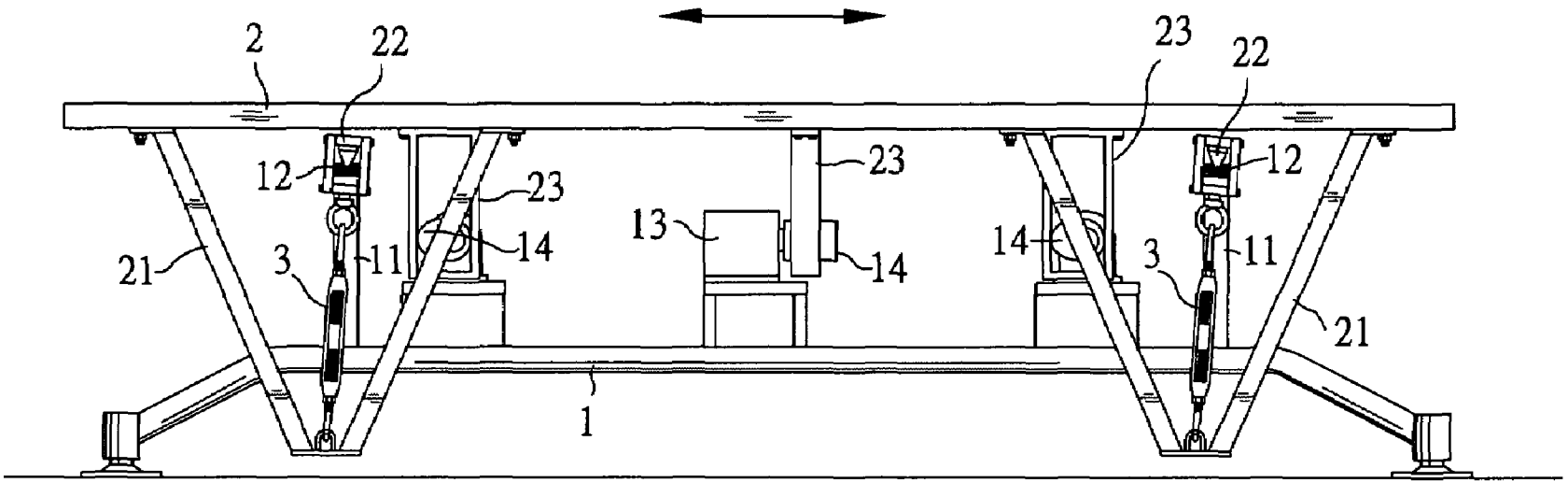
FIG. 5 is a schematic view of back and forth movements of the invention.
Figure 6:
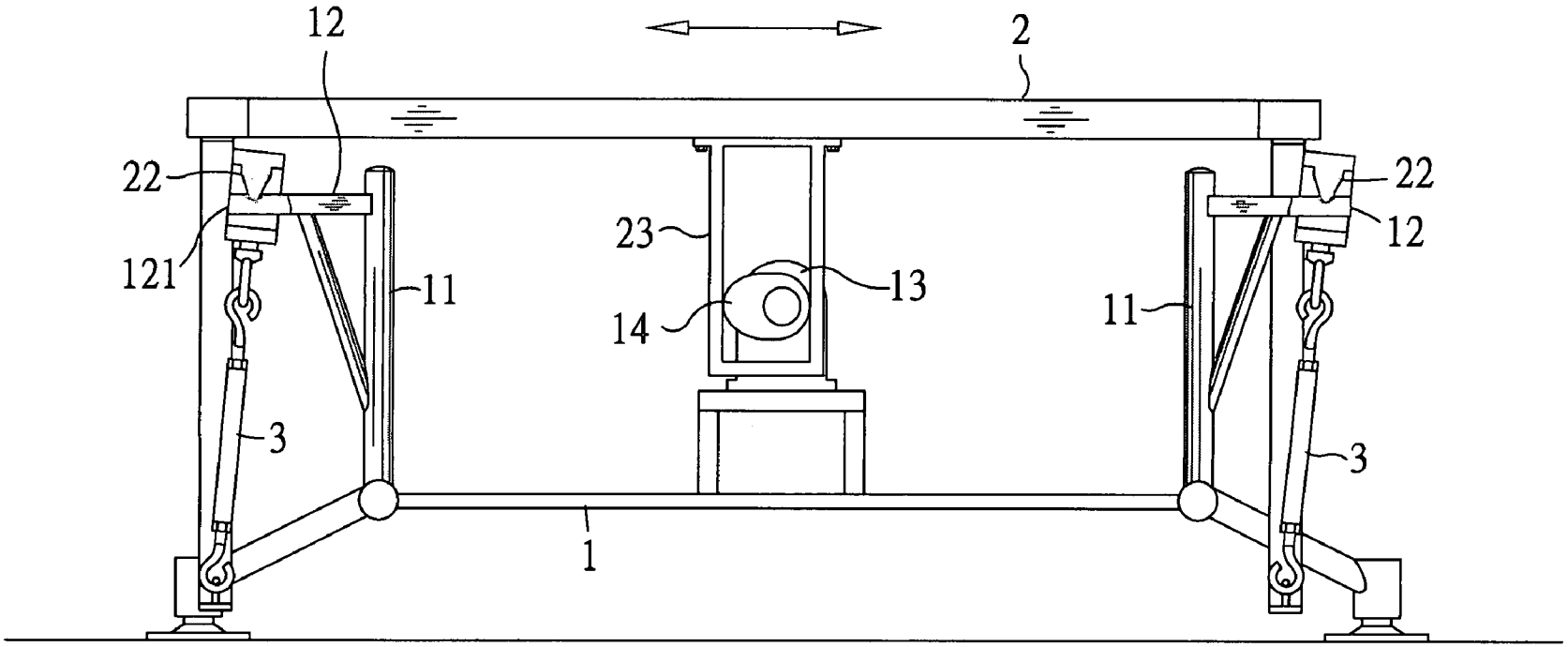
FIG. 6 is a schematic view of sideway movements of the invention.

If a controller turns on the motive power motor 13 to drive the cam 14 to operate, the driving frame 23 under the bed plank 2 is pushed by the cam 14 to move back and forth, so that the bed plank 2 moves back and forth accordingly (as shown in FIG. 5). Now, the conical fixing member 22 in the bed plank 2 also can move freely in 360 degrees with respect to the conical surface in the conical hole 121 of the rod stand 12 on the hanging frame 11 of the bed base 1, so as to achieve the sway without a restricted angle. Similarly, a driving frame 23 at another direction under the bed plank 2 is pushed by a cam 14 at a corresponding direction, and thus the bed plank 2 moves sideways (as shown in FIG. 6). In the meantime, the conical fixing member 22 in the bed plank 2 also can rotate freely with a turning angle of 360 degrees with respect to the conical surface of the conical hole 121 of the rod stand 12 on the hanging frame 11 of the bed base 1, so as to achieve the sway without a restricted angle. If a user lies down in a bed, the user can move and relax their body and skin, and thus preventing bedsores caused by the hot, windless, moist climate when the user's body or skin is in touch with the bed plank for a long time. In the meantime, the user's body and organs obtain a timely moving effect when the user's body is swayed, so as to maintain the normal functions of each organ.

Figure 7:
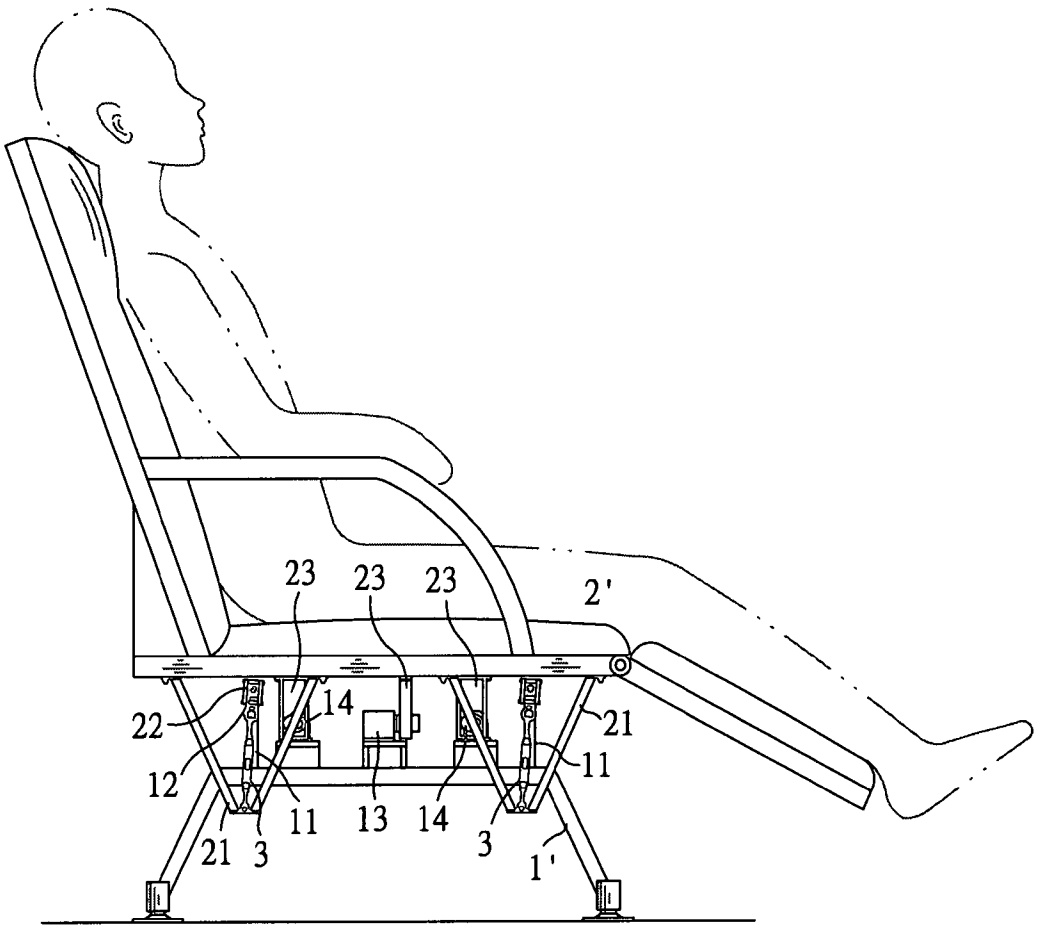
FIG. 7 is a schematic view of applying the present invention to a chair.

Further, the structure of the invention can be applied for the operation of chairs (as shown in FIG. 7), and a vertical hanging frame 11 and suspending stand 21 are installed at a chair base 1' and a chair plank 2' respectively, and a suspensor 3 is hung between the hanging frame 11 and the suspending stand 21 for sustaining a heavy weight. The chair plank 2' includes a conical fixing member 22 therein, and the chair base 1' includes a conical hole 121 at the rod stand 12 of the hanging frame 11, such that each conical fixing member 22 in the chair plank 2' is installed in the conical hole 121 of the rod stand 12 on the hanging frame 11 of the chair base 1' as shown in FIG. 3B. With the design of a turning angle of 360 degrees with respect to a conical surface, a free movement without a restricted angle can be achieved. Further, the chair base 1' includes a plurality of motive power motors 13 therein, so that a spindle of the motive power motor 13 installs a cam 14 engaged at a position under the chair plank and disposed at a position corresponding to the driving frame 23 for limiting its position, so as to achieve the foregoing back-and-forth and sideway swaying effect.

Of course, the movements of the cam in accordance with the invention can be achieved by different mechanical methods including gear discs or chains to produce the equivalent effects of the invention, and thus overcoming the problem that comes with the electromagnetic design.

In summation of the above description, the present invention herein enhances the performance than the conventional structure and further complies with the patent application requirements and is submitted to the Patent and Trademark Office for review and granting of the commensurate patent rights.

What is claimed is:

1. An electric-powered mechanical single-plank bed, comprising:

a bed base;

a bed plank disposed over said bed base, said bed plank having a plurality of conical fixing members;

a plurality of driving frames disposed under said bed plank;

a plurality of hanging frames, respectively disposed at a front left, a front right, a rear left and a rear right position of the bed base, each hanging frame having a rod stand;

a plurality of suspending stands disposed under the bed plank;

a plurality of suspensors, each being installed between a respective hanging frame and a respective suspending stand for sustaining a heavy weight;

a plurality of motive power motors installed on said bed base, each motive power motor having a spindle;

a plurality of cams, each cam being installed on the spindle of a respective motive power motor and being engaged to a respective driving frame, so that when said motive power motors are turned on, the cams are driven, causing said bed plank to be pushed back and forth by said cams to produce a back-and-forth or sideway sway, to achieve a swaying effect; and a plurality of conical fixing members;

wherein said hanging frames and said suspending stands are provided for hanging said suspensors, and for coupling said bed base with said bed plank, and wherein each rod stand includes a conical hole, such that a respective conical fixing member is installed into a respective conical hole, and a turning angle of 360 degrees on a conical surface achieves a free movement without any restricted angle.

2. An electric-powered mechanical single-plank chair, comprising:

a chair base;

a chair plank disposed over said chair base, said chair plank having a plurality of conical fixing members;

a plurality of driving frames disposed under said chair plank;

a plurality of hanging frames, respectively disposed at a front left, a front right, a rear left and a rear right position of the chair base, each hanging frame having a rod stand;

a plurality of suspending stands disposed under the chair plank;

a plurality of suspensors, each being installed between a respective hanging frame and a respective suspending stand for sustaining a heavy weight;

a plurality of motive power motors installed on said chair base, each motive power motor having a spindle;

a plurality of cams, each cam being installed on the spindle of a respective motive power motor and being engaged to a respective driving frame, so that when said motive power motors are turned on, the cams are driven, causing said chair plank to be pushed back and forth by said cams to produce a back-and-forth or sideway sway, to achieve a swaying effect; and a plurality of conical fixing members;

wherein said hanging frames and said suspending stands are provided for hanging said suspensors, and for coupling said chair base with said chair plank, and wherein each rod stand includes a conical hole, such that a respective conical fixing member is installed into a respective conical hole, and a turning angle of 360 degrees on a conical surface achieves a free movement without any restricted angle.

* * * * *